US005092608A

United States Patent [19]

Snipes

[11] Patent Number: 5,092,608

[45] Date of Patent: Mar. 3, 1992

[54] SLING TAG

[76] Inventor: Terry W. Snipes, 740 S. Federal Hwy. #314, Pompano Beach, Fla. 33062

[21] Appl. No.: 648,883

[22] Filed: Jan. 31, 1991

[51] Int. Cl.[5] ..... A63B 65/10

[52] U.S. Cl. ..... 273/424

[58] Field of Search ..... 273/424, 425, 415; 446/46–48

[56] References Cited

U.S. PATENT DOCUMENTS

| | | | |
|---|---|---|---|
| 2,640,699 | 6/1953 | Garbo | 273/424 |
| 3,026,110 | 3/1962 | Hess et al. | 273/424 X |
| 3,480,280 | 11/1969 | Gamertsfelder | 273/415 |
| 4,253,672 | 3/1981 | Milzoff et al. | 273/424 |
| 5,026,054 | 6/1991 | Osher et al. | 273/424 X |

FOREIGN PATENT DOCUMENTS

| | | | |
|---|---|---|---|
| 915283 | 7/1946 | France | 273/424 |
| 8603084 | 7/1988 | Netherlands | 273/424 |

*Primary Examiner*—Paul E. Shapiro
*Attorney, Agent, or Firm*—Stanley W. Sokolowski

[57] ABSTRACT

A Game Device and method for its manufacture are described, the device comprises a sandwich of a foam donut, weight pellets in the hole of the donut, cloth discs to contain these elements, and plastics discs of smaller diameter affixed externally. The method comprises steps of manufacturing the elements, and assembly into a "sling tag" that is used in the game of the same name.

6 Claims, 1 Drawing Sheet

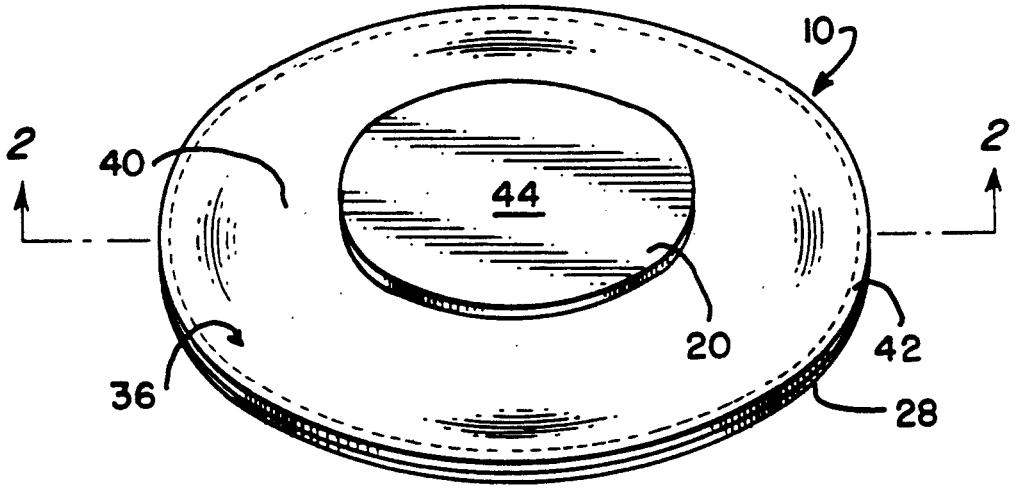
FIG. 1
FIG. 2
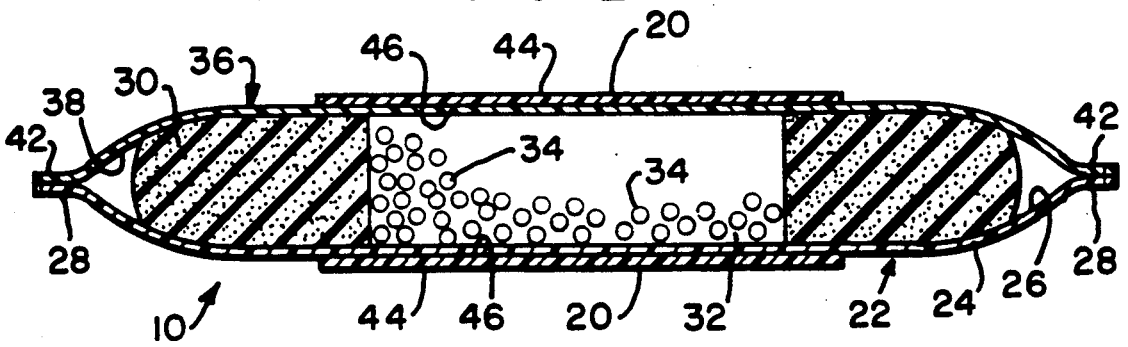
FIG. 3
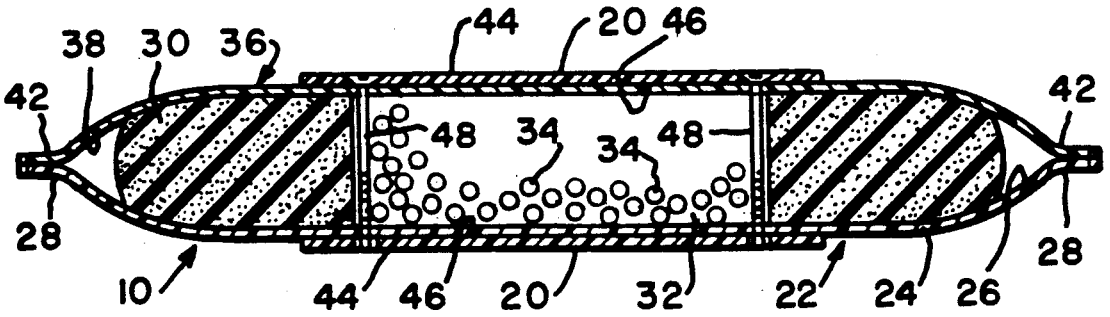

SLING TAG

BACKGROUND OF THE INVENTION

Sling Tag is a game invented to safely provide exercise for children. It requires a device to be skimmed along a floor or play area toward an opponent in a manner that will touch the opponent without injury, yet will make it difficult for the opponent to capture the device. The device is called a sling tag, and for quickness of play requires surfaces that will easily slide over the surface that comprises the playing court. It has been found that a spinning motion adds to the level of skill required to avoid or to capture the sling tag.

SUMMARY OF THE INVENTION

This device provides a game element that is safe for children to use, and will promote the development of coordination skills. Smooth rigid discs provide the skimming surfaces of the sling tag while larger diameter discs made of pliable materials contribute bulk and safe contact surfaces. A donut structure confines pellets which add to the weight of the sling tag, keeping it low and on the ground, and preventing its rising like a frisbee. Because of their moveability within the hole of the donut, the pellets cause variations in spinning speed and sliding path of the sling tag.

BRIEF DESCRIPTION OF THE DRAWINGS

FIG. 1 is an isometric view of the invention.

FIG. 2 is a cross sectional view taken along 2—2.

FIG. 3 is a cross sectional view of another embodiment taken along 2—2.

DETAILED DESCRIPTION OF THE INVENTION

The apparatus comprises a flexible impact body 10 sandwiched between rigid sliding discs 20. The body further comprises a first flexible disc 22, having an outer surface 24 which may be smooth or soft textured, an inner surface 26, and a circumferential margin 28. Located approximately concentrically on the inner surface is a donut shaped ring 30 made of pliable resilient material. Within the cavity of the ring 32 are infrangible pellets 34 of a weight selected to keep the apparatus in use from rising above children's waist height, and which are free to move within the cavity. Covering this assembly is a second flexible disc 36 similar in construction to the first disc 22, having an inner surface 38, an outer surface 40 and a circumferential margin 42. The circumferential margins 28 and 42 are sealed together by stitching or adhesive methods. The rigid discs 20 further comprise a sliding surface 44 and an adhering surface 46. One rigid disc is attached approximately coaxially with the adhering surface 46 contiguous to each outer surface 24 or 46 by adhesive or mechanical means.

FIG. 3 shows another embodiment in which the flexible body 20 is retained between the rigid sliding discs 10 by mechanical fastening means 48 such as screws or rivets.

As different embodiments of the present invention may be made without departing from the spirit and scope thereof, it is to be understood that the invention is not limited to the specific embodiments as described herein, except as defined in the appended claims.

What is claimed is:

1. A sling tag comprising two flexible discs each having an outer surface, an inner surface and a circumferential margin;

two rigid discs each having a sliding surface and an adhering surface;

a pliable resilient ring having a cavity; and a plurality of spheroidal pellets;

wherein the pellets moveably occupy the cavity, the ring is coaxially restrained between the inner surfaces of the flexible discs, the circumferential margins are sealed together, and the adhering surface of each rigid disc is coaxially affixed to the outer surface of a flexible disc.

2. The sling tag of claim 1 in which the rigid discs are adhesively attached to the flexible discs.

3. The sling tag of claim 1 in which the rigid discs are mechanically attached to the flexible discs.

4. A method of manufacturing a sling tag comprising the steps of cutting discs from a flexible material, cutting ring shapes of smaller diameter from a thicker, pliable resilient cellular material, cutting rigid discs of yet smaller diameter, laying a pliable resilient ring coaxially on the surface of a first flexible disc, partially filling the hole of said ring with a plurality of infrangible pellets, laying a second flexible disc coaxially over said ring, sealing the edges of the first and second flexible discs together, and affixing a rigid disc coaxially to each flexible disc outer surface.

5. The method of claim 4 wherein the assembly of the rigid discs to the flexible discs employs and adhesive material.

6. The method of claim 4 wherein the assembly of the rigid discs to the flexible discs employs mechanical fasteners.

* * * * *